US006308864B1

(12) United States Patent
Messer

(10) Patent No.: US 6,308,864 B1
(45) Date of Patent: Oct. 30, 2001

(54) MODULAR ADHESIVE BEAD DISPENSER

(75) Inventor: Joseph S. Messer, Vicksburg, MI (US)

(73) Assignee: Greco Manufacturing, Inc., Buchanan, MI (US)

( * ) Notice: Subject to any disclaimer, the term of this patent is extended or adjusted under 35 U.S.C. 154(b) by 0 days.

(21) Appl. No.: 09/578,966

(22) Filed: May 25, 2000

(51) Int. Cl.[7] ..... B67D 5/52
(52) U.S. Cl. ..... 222/137; 222/334
(58) Field of Search ..... 222/137, 334, 222/389, 276

(56) References Cited

U.S. PATENT DOCUMENTS

| | | | | |
|---|---|---|---|---|
| 4,066,188 | | 1/1978 | Scholl et al. . | |
| 4,291,641 | | 9/1981 | Nowak . | |
| 4,372,799 | | 2/1983 | Rasmussen . | |
| 4,523,540 | | 6/1985 | Walter . | |
| 4,743,469 | | 5/1988 | Lehmann . | |
| 4,891,249 | | 1/1990 | McIntyre . | |
| 4,898,302 | | 2/1990 | Byerly et al. . | |
| 4,949,668 | | 8/1990 | Heindel et al. . | |
| 4,964,362 | | 10/1990 | Dominguez . | |
| 4,983,109 | | 1/1991 | Miller et al. . | |
| 5,016,784 | | 5/1991 | Batson . | |
| 5,145,689 | | 9/1992 | Allen et al. . | |
| 5,305,917 | * | 4/1994 | Miller et al. | 222/137 |
| 5,371,178 | | 12/1994 | Nguyen . | |
| 5,407,917 | * | 4/1995 | Tracy et al. | 222/137 |
| 5,494,228 | | 2/1996 | Eaton et al. . | |
| 5,620,139 | | 4/1997 | Ziecker . | |
| 5,728,219 | | 3/1998 | Allen et al. . | |
| 5,806,720 | | 9/1998 | Zook . | |
| 5,861,119 | | 1/1999 | Merser . | |
| 5,882,133 | | 3/1999 | Chao et al. . | |
| 5,939,499 | | 8/1999 | Anderson et al. . | |
| 5,965,662 | | 10/1999 | Krebs et al. . | |

* cited by examiner

*Primary Examiner*—Philippe Derakshani
(74) *Attorney, Agent, or Firm*—Baker & Daniels

(57) ABSTRACT

A modular adhesive bead dispensing unit having at least one bead dispensing module. The module includes a mounting frame for mounting the module to the unit, and at least one adhesive dispensing manifold. The manifold includes a housing having an inlet opening for introducing adhesive into the housing, an outlet opening for dispensing the adhesive, a non-stick compressible fitting within the outlet opening, the fitting having an opening therethrough, and an outlet closing member receivable within the fitting opening for starting and stopping flow of an adhesive bead from the head. The module also includes at least one actuation unit for retracting and reinstalling the outlet closing member within the fitting opening. The manifold for dispensing adhesive has a sleeve mounted in the outlet opening, adjacent the fitting, and a retainer for retaining the fitting within the outlet opening and for adjustably pressing the fitting into the sleeve. The sleeve has a through opening, which is aligned with the fitting opening for passage of the outlet closing member and adhesive therethrough. The fitting is made of a non-stick compressible material, and the retainer is adjusted to compress the fitting to form an environmental seal between the fitting and outlet closing member when the outlet closing member is in a closed position such that the adhesive dispensing unit is particularly suitable for dispensing a fast acting moisture curable adhesive. The manifold may include multiple outlet openings and a respective number of outlet closing members. In one embodiment, the module has a separate actuation unit connected to each outlet closing member. In a second embodiment, the module utilizes the same manifold as the first embodiment; however, the outlet closing members are all actuated simultaneously by a single actuation unit.

25 Claims, 9 Drawing Sheets

MODULAR ADHESIVE BEAD DISPENSER

BACKGROUND OF THE INVENTION

1. Field of the Invention

This invention relates generally to a modular adhesive bead dispenser, and in particular, to a modular adhesive bead dispenser that is capable of dispensing fast curing adhesives without the nozzles becoming obstructed with hardened adhesive.

2. Discussion of the Prior Art

Numerous applications require the deposition of one or more adhesive beads onto a substrate such as used in the manufacturing of disposable diapers, sanitary napkins, and in preformed structural panel assemblies. There exists a variety of applicators for adhesive, including hand held and machine mounted that are capable of depositing both singular and multiple beads. Some of these adhesive applicators use air to assist in spraying the adhesive, such as is disclosed in U.S. Pat. No. 4,891,249. Also techniques have been developed for varying the shape of the bead such as a spiral deposition as found in U.S. Pat. Nos. 4,949,668 and 4,983,109.

Also, blowing dies have been developed such as disclosed in U.S. Pat. No. 5,145,689, which are particularly designed for hot melt adhesives. Some adhesive applicators use intermittently operated or air assisted dies. Melt blown applicators provide a generally uniform covering with a predetermined adhesive width to be deposited on a substrate, but do not have precise edge control, which is needed in some applications. Spiral nozzles on the other hand, deposit a controlled spiral bead on the substrate to provide good edge control but lack uniform coverage of the substrate. Also, in order to have more control over the width of the bead, a modular die for applying adhesives, such as disclosed in U.S. Pat. No. 5,728,219 ('219), incorporated herein by reference, has been developed including interchangeable die bodies that include an internal valve for controlling the flow of polymer therethrough. Although the modular dies disclosed in '219 do provide increased flexibility over fixed die systems, it would be desirable to provide an adhesive dispensing unit with modular sections having gang actuated dispensing nozzles as well as modular sections where each dispensing nozzle operates individually. This dual modular section approach would provide maximum efficiency and variability of the adhesive dispensing unit.

In addition, there is an increasingly popular form of adhesive known as fast or rapid moisture cured adhesives. Such an adhesive may have a polyurethane base as is disclosed in U.S. Pat. No. 5,965,662, herein incorporated by reference. This type of adhesive provides a strong bond and has been found suitable for numerous applications including preformed structural assemblies. When these adhesives are dispensed, exposure to moisture in the air or to added moisture sprayed or otherwise applied to the adhesives, cause them to cure within minutes or even less.

One problem, though, with these rapid curing adhesives is that many standard or known adhesive applicators are not suitable. As exposure to air and moisture cures the adhesive within a rapid time, nozzle orifices can become clogged or valve stems may be adhered shut such that the unit will no longer function.

Due to the problem of dispensing highly reactive adhesives, a syringe-type adhesive applicator has been developed as disclosed in U.S. Pat. No. 5,016,784, incorporated herein by reference, which utilizes a non-stick polymeric seal and a hydrocarbon grease disposed between the seal and adhesive to provide a moisture impervious environment for the adhesive. The drawback to this syringe-type applicator is that it is designed primarily for low volume usage. As the syringe contains a fixed and limited amount of adhesive, it is not readily adaptable to an assembly line type application having continuous feed capabilities. Furthermore, on the opposite end of the nonstick polymeric seal is the dispensing nozzle, which is merely covered with a standard end cap. As such, after dispensing adhesive, the adhesive remaining in the nozzle area and around the cap may have been exposed to moisture and may solidify thereby clogging said nozzle.

One commercially available unit from BSI does provide a system that is intended for delivering multiple beads of rapid curing adhesive in a high volume application. This system includes a manifold having an inlet for the adhesive, an inner passageway in the manifold, and multiple nozzle ports connected with the passageway for dispensing the adhesive on a substrate. To preclude the nozzle orifices from clogging when the adhesive flow has been terminated, the nozzle tips are immersed in an oil bath. This allows the adhesive at the end of the nozzles, which has been exposed to the atmosphere, to drain into the oil and precludes any moisture or air from entering into the nozzle. One problem with this system is that when the nozzles are removed from the oil to continue dispensing adhesive, oil is pulled along and contaminates the initial portion of the bead. In addition, if frequent stops and starts are necessary, operators are reluctant to dip the nozzles into the oil as required due to the continual mess and contamination that results therefrom. Of course, if the nozzles are not dipped in the oil when the adhesive flow is turned off, then moisture will cure the adhesive in the nozzle orifice causing the unit to malfunction.

It is therefor an object of the invention to provide an adhesive dispensing unit that is suitable for an industrial high volume application and is capable of dispensing a highly reactive moisture cured adhesive such that the dispensing nozzles will not become clogged and without the necessity of immersing the nozzles in an oil bath.

It is another object of the invention to provide an adhesive dispensing unit having a modular design with manifolds having synchronously actuated adhesive dispensing orifices. It is also an object of the invention to provide other manifolds having individually actuated adhesive dispensing orifices, which can be individually controlled so as to provide optimum variability to the number and placement of adhesive beads.

SUMMARY OF THE INVENTION

It is a feature of the invention to provide a modular adhesive bead dispensing unit having at least one bead dispensing module. The module includes a mounting frame for mounting the module to the unit, and at least one adhesive dispensing manifold. The manifold includes a housing having an inlet opening for introducing adhesive into the housing, an outlet opening for dispensing the adhesive, a non-stick compressible fitting within the outlet opening, the fitting having an opening therethrough, and an outlet closing member receivable within the fitting opening for starting and stopping flow of an adhesive bead from the head. The module also includes at least one actuation unit for retracting and reinstalling the outlet closing member within the fitting opening.

It is another feature of the invention that the manifold for dispensing adhesive has a sleeve mounted in the outlet opening, adjacent the fitting, and a retainer for retaining the fitting within the outlet opening and for adjustably pressing the fitting into the sleeve. The sleeve has a through opening, which is aligned with the fitting opening for passage of the outlet closing member and adhesive therethrough.

Another feature of the invention is that the fitting is made of a non-stick compressible material, and the retainer is adjusted to compress the fitting to form an environmental seal between the fitting and outlet closing member when the outlet closing member is in a closed position.

It is also a feature of the invention that the manifold may include multiple outlet openings and a respective number of outlet closing members. In one embodiment, the module has a separate actuation unit connected to each outlet closing member.

It is a further feature of the invention that a second embodiment module also has a manifold that includes multiple outlet openings and respective number of outlet closing members, which are all actuated simultaneously by a single actuation unit.

Another feature of the invention is that the fittings include a nozzle tip and the outlet closing members include a nozzle end. The adhesive bead dispensing unit further includes a cleaning mechanism for wiping adhesive from the nozzle tips and nozzle ends.

Yet another feature of the invention is that the end of the sleeve which is pressed against the fitting is tapered and a corresponding end of the fitting is tapered to provide a compression fit when said retainer ring is tightened.

Also, it is a feature of the invention that the outlet closing member includes a nozzle end wherein the nozzle end is substantially flush with the nozzle tip when in a closed position, and when in an open position the nozzle end is withdrawn into the passage beyond the fitting to allow adhesive material to flow through the fitting and out of the nozzle tip.

An additional feature of the invention is that the housing includes a third opening and a second fitting such that a portion of the outlet closing member extends through the second fitting and third opening beyond the housing to enable retraction of the outlet closing member.

A further feature of the invention is that the manifold includes a second sleeve in the third opening and a second retainer adjustably pressing the second fitting against said second sleeve. The second fitting and second sleeve also have mating tapers such that tightening the retainer will compress the fitting to form a slight interference fit with said outlet closing member.

It is also a feature of the invention that the portion of the outlet closing member extending out of said housing is threaded for receipt with a retracting mechanism.

In another embodiment of the invention, the manifold for dispensing adhesive has staggered rows of outlet openings.

One additional feature of the invention is that the modular adhesive bead dispensing unit may include at least one gang actuated adhesive dispensing module, and at least one individually actuated dispensing module, both said modules including a manifold having at least one adhesive inlet, multiple outlet openings for dispensing adhesive, and a retractable outlet closing member for each outlet. The gang actuated modules have a single actuation unit for moving all outlet closing members contained in the gang module simultaneously from the open position to the closed position. The individually actuated modules have a separate actuation device for each outlet opening and corresponding outlet closing member of the individually actuated module. The separate actuation devices independently move each outlet closing member from the open to the closed position.

DESCRIPTION OF THE PREFERRED EMBODIMENT

Figure 1:
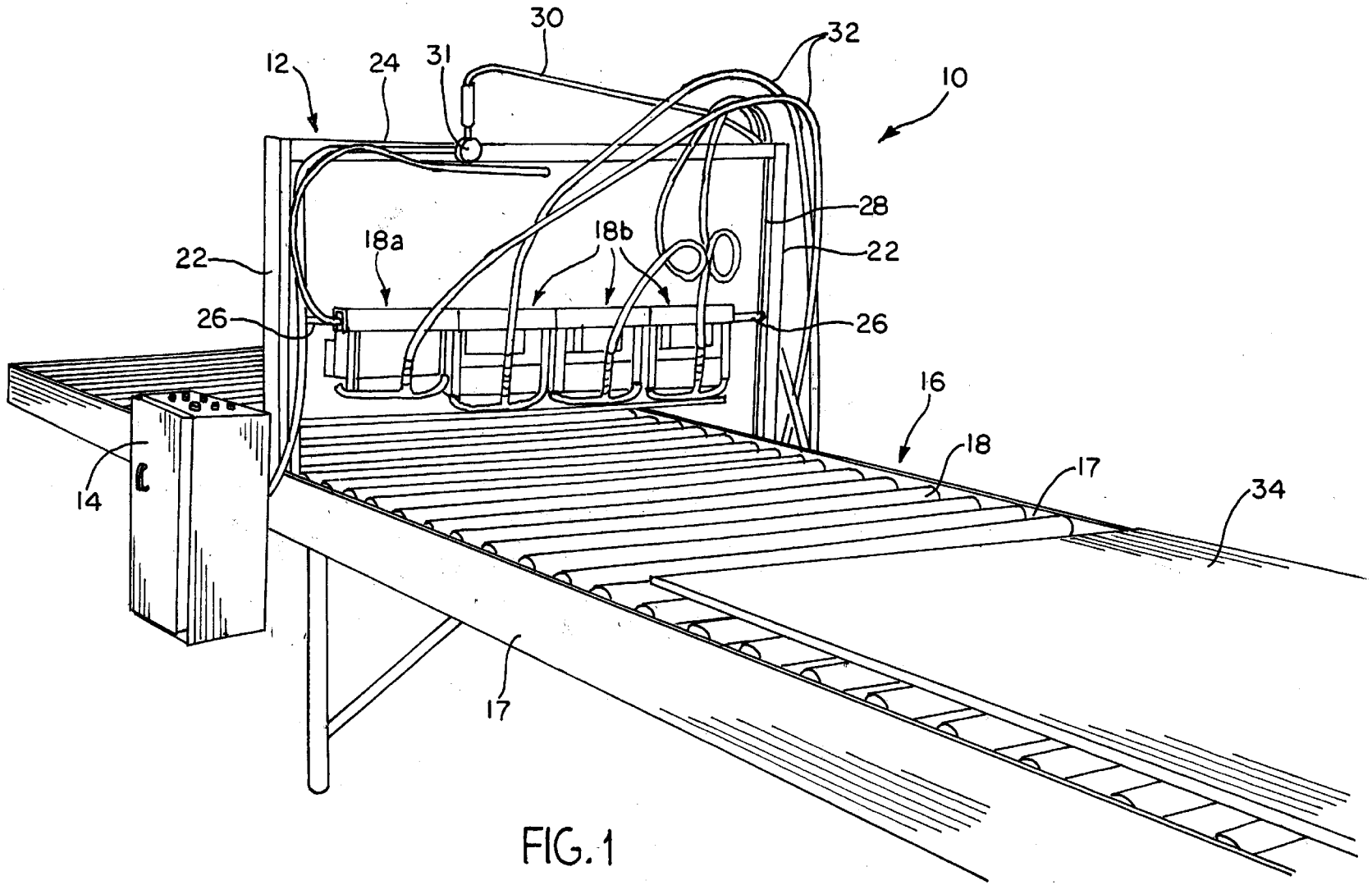
FIG. 1 is a perspective view of a modular bead dispensing unit of the subject invention.

Referring to FIG. 1 an adhesive dispensing unit of the present invention is generally referred to as 10. Adhesive dispensing unit 10 includes a support frame generally indicated by 12, a control module 14, a conveyor assembly generally indicated by 16, an individually actuated dispenser head generally indicated by 18*a*, and multi or gang actuated dispenser heads 18*b*. Conveyor 16 includes side rails 17 and rollers 19. Support frame 12 includes a pair of upright frame members 22 and a cross frame member 24. Dispenser heads 18*a* and 18*b* are supported on support frame 12 by dispenser supports 26, which engage vertical slots or tracks 28, for vertical movement of the dispenser heads. Attached to dispenser heads 18*a* and 18*b* are pneumatic lines 30 having a regulator 31 and adhesive lines 32. A substrate 34 is positioned on conveyor assembly 16 for slidable movement beneath dispenser heads 18*a* and 18*b* for receipt of adhesive beads to be deposited thereon.

Figure 2:
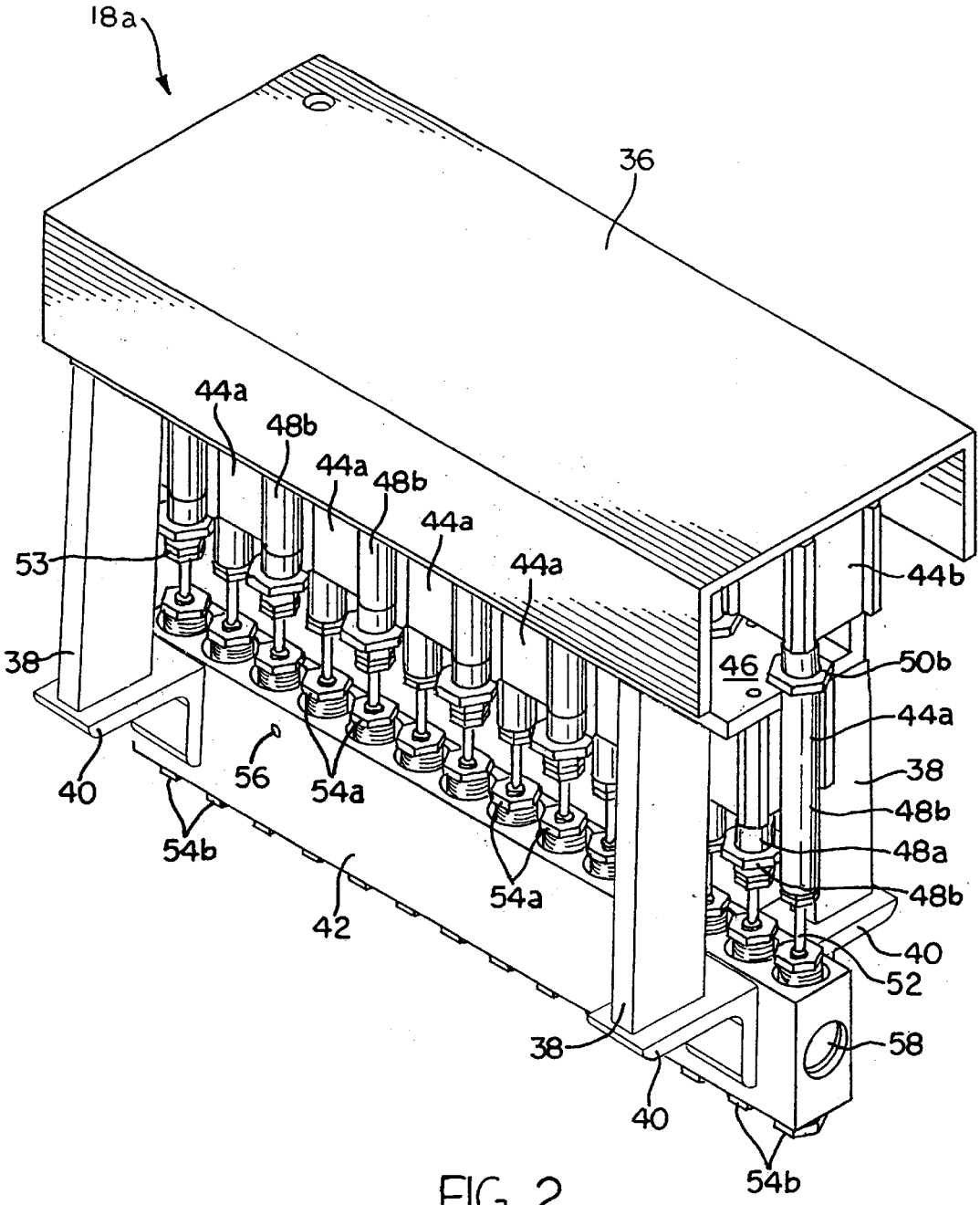
FIG. 2 is a perspective view of an adhesive dispensing head having individually actuated dispenser nozzles.
Figure 3:
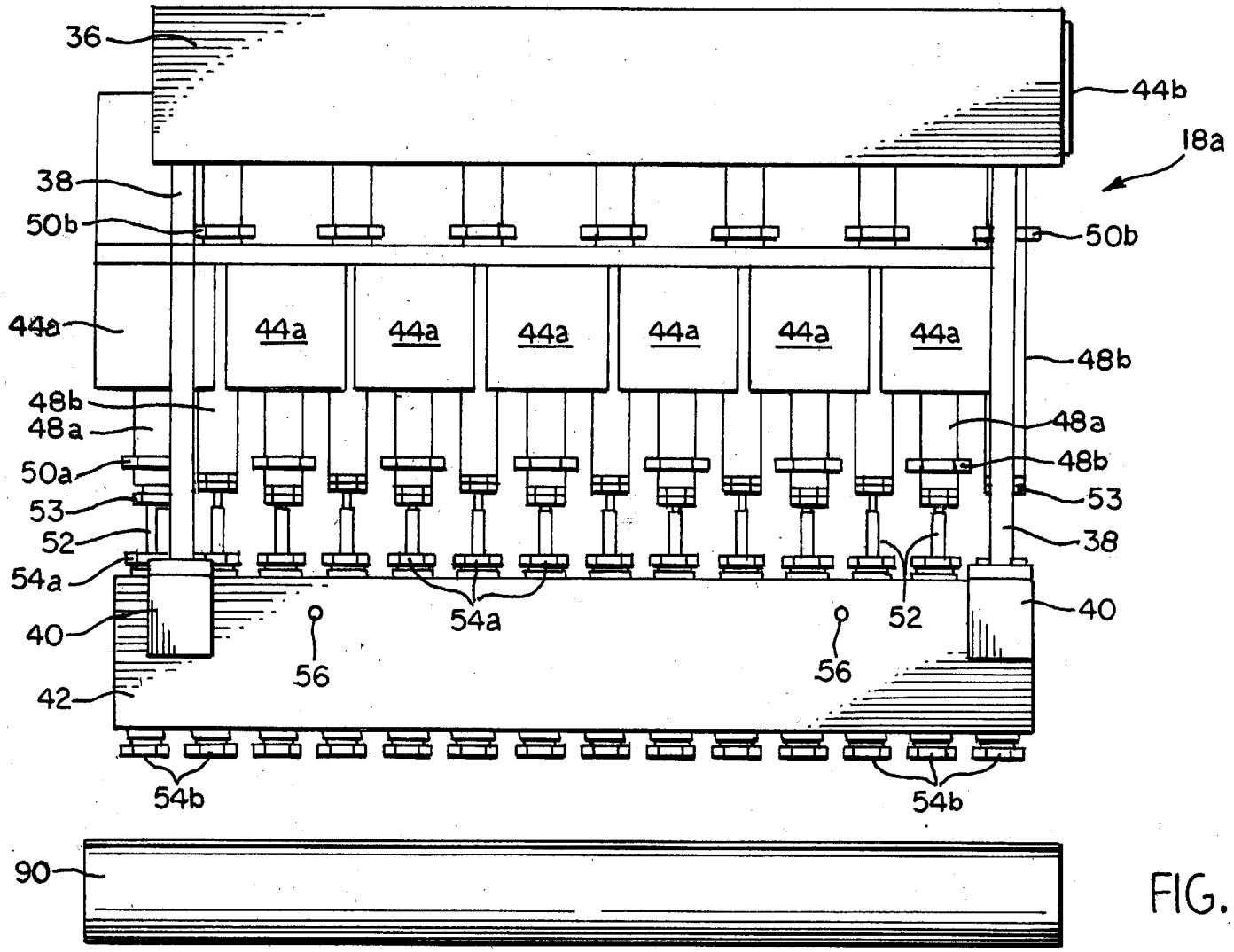
FIG. 3 is a front view of the individually actuated adhesive dispenser head.
Figure 4:
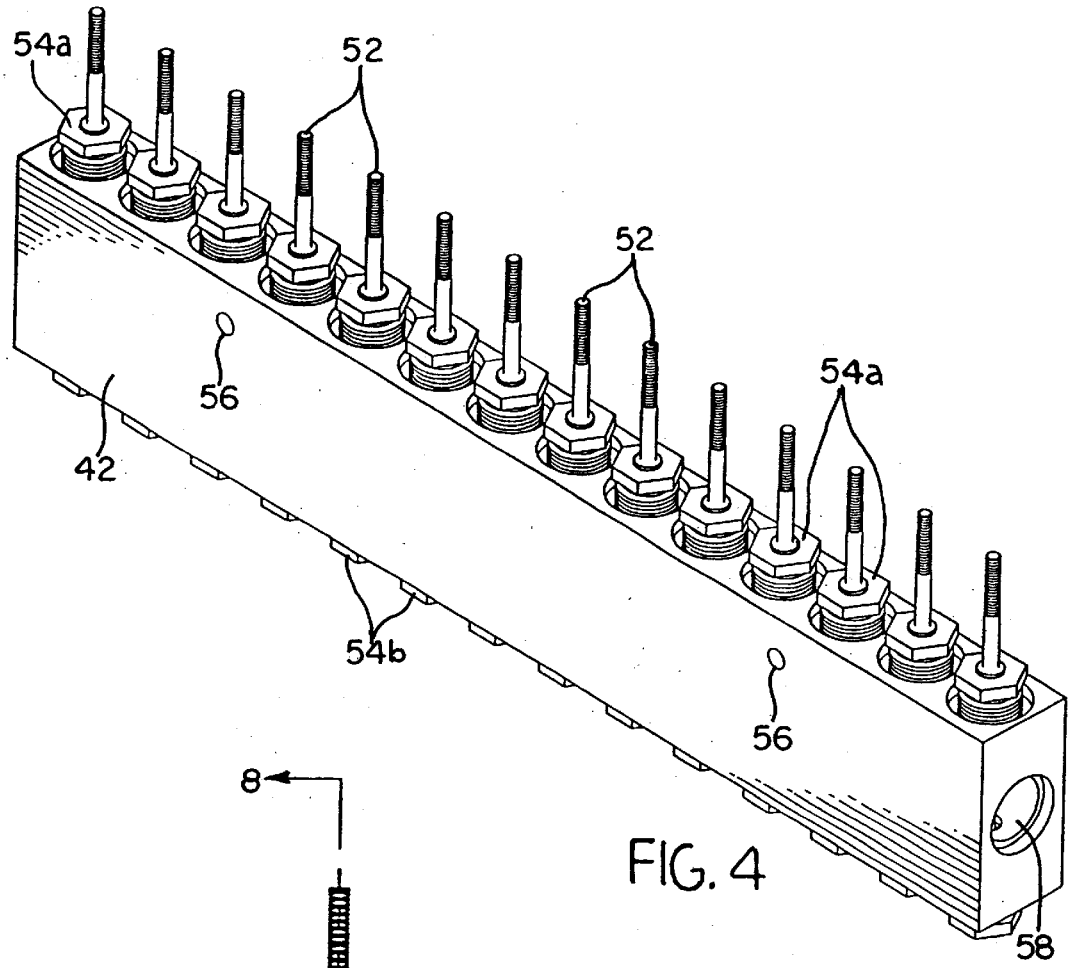
FIG. 4 is a perspective view of an adhesive dispensing manifold used with the dispensing head.
Figure 5:
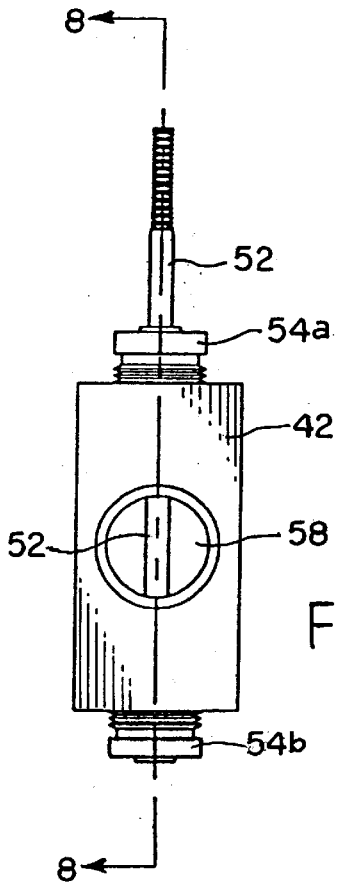
FIG. 5 is an end view of the adhesive dispensing manifold.
Figure 6:
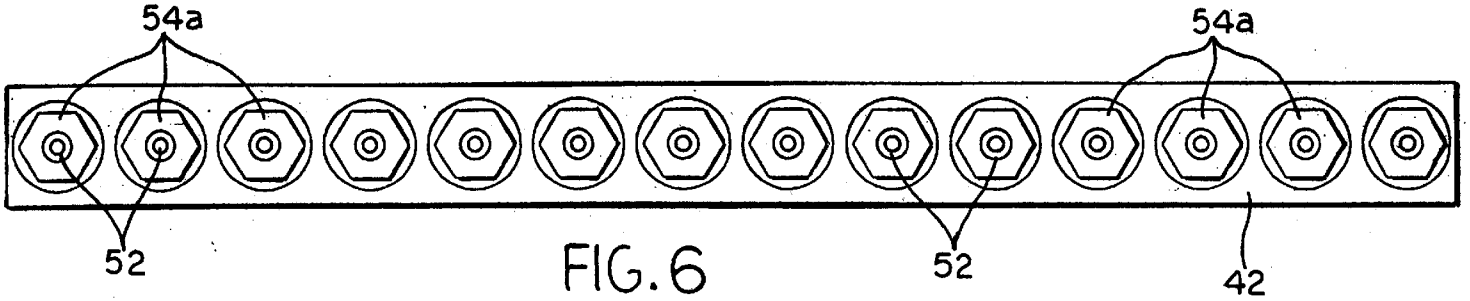
FIG. 6 is a top view of the adhesive dispensing manifold.
Figure 7:
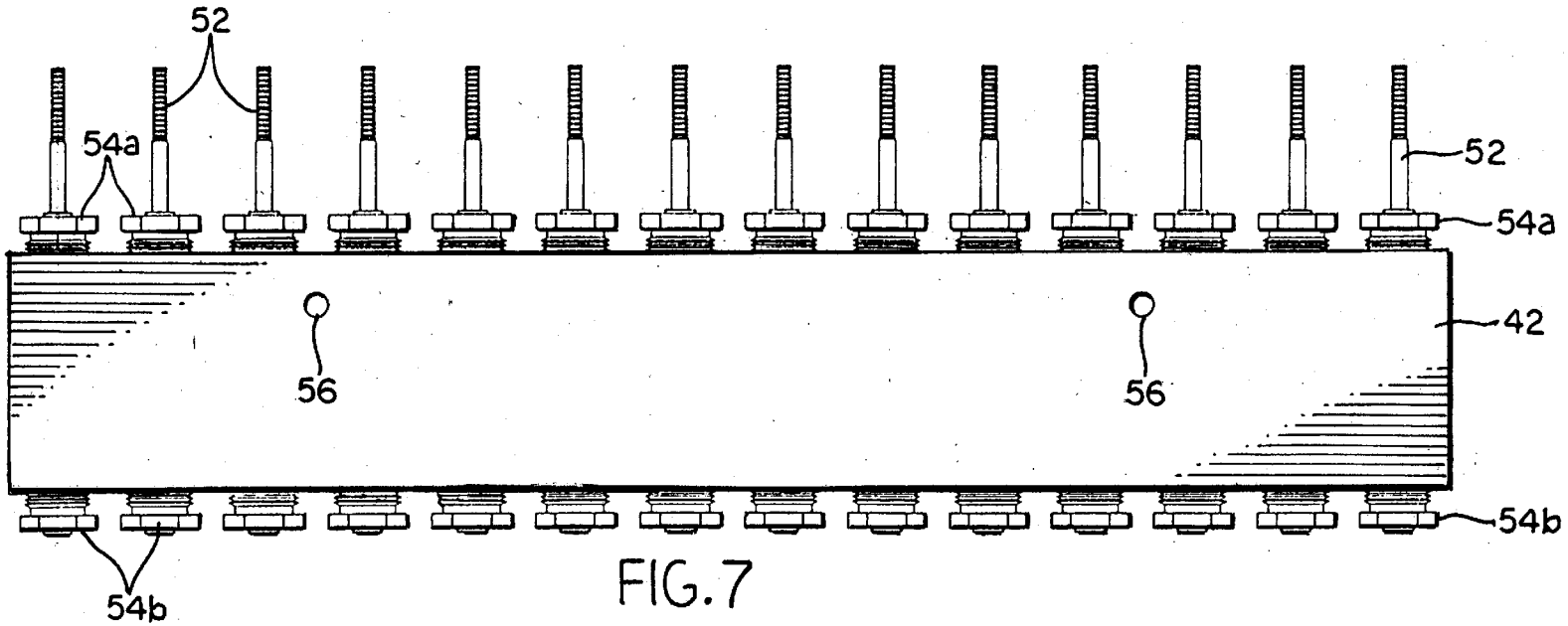
FIG. 7 is a front view of the adhesive dispensing manifold.

Now referring to FIGS. 2 and 3 individually actuated dispenser head 18*a* is shown in a perspective view and from a frontal view, respectively. The structural support for head 18*a* is obtained from channel support 36, vertical supports 38 and mounting brackets 40. The adhesive dispensing portion of dispenser head 18*a* includes a manifold or housing block 42, a lower row of pneumatic cylinders 44*a* and an upper row of pneumatic cylinders 44*b* with the upper and lower rows of cylinders being divided by a plate 46. Alternating upper and lower cylinders 44*a*,44*b* are connected and operate adjacent dispensing units 59 (FIG. 8) of manifold 42 as described below.

Extending from lower pneumatic cylinders 44*a* are short extension rods 48*a*, which have a hexagonal shoulder 50*a* for use in turning and securing the rods, and extending from upper pneumatic cylinders 44*b* are long extension rods 44*a* also having a hexagonal shoulder 50*b*. Attached to the lower end of each extension rod 48*a* and 48*b* is a valve stem or outlet closing member 52 (also see FIGS. 4–7). A pair of jam nuts 53 secures each valve stem 52 to its corresponding extension rod 48*a* or 48*b*. Inserted in the top of manifold 42 and partially surrounding valve stem 52 are upper retainer rings 54*a*, and inserted into the bottom of manifold 42 are lower retainer rings 54*b*. Also located in manifold 42 are adhesive inlet apertures 56 and a through passage 58.

Figure 8:
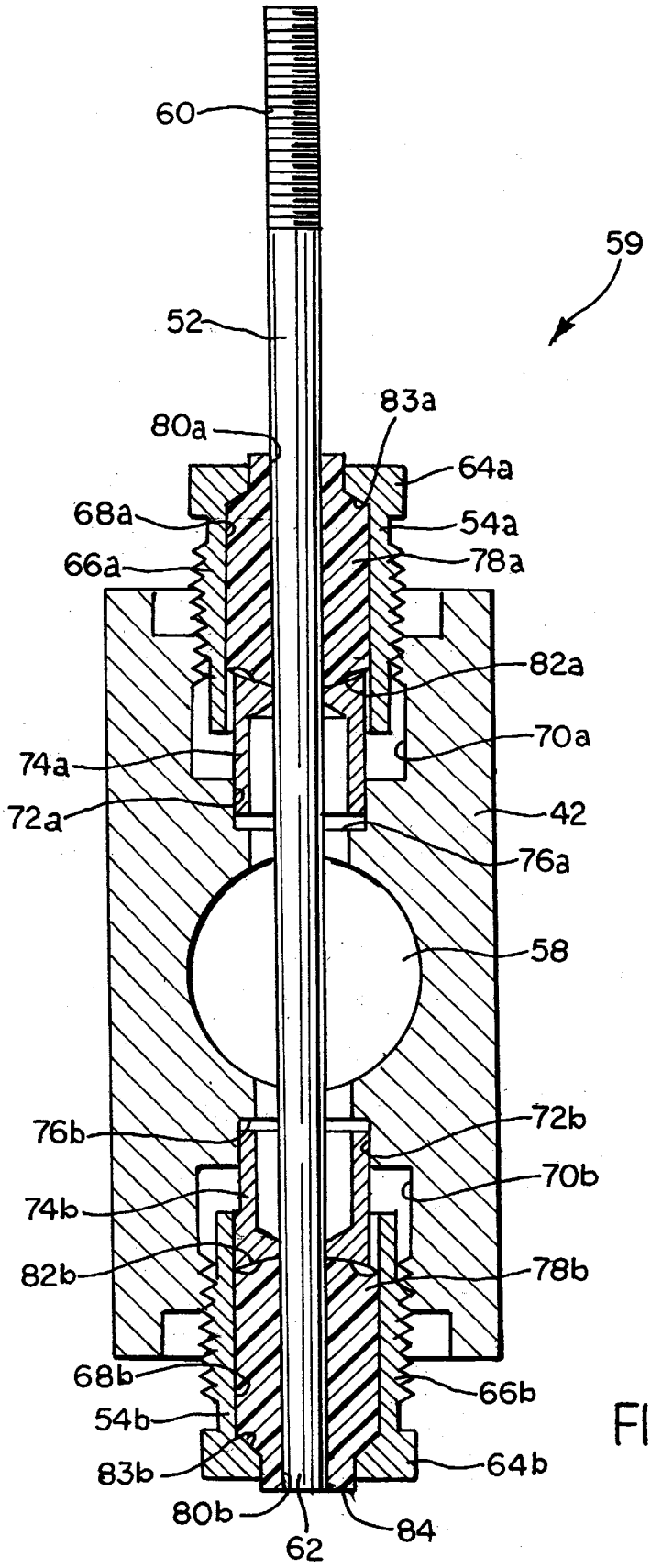
FIG. 8 is a cross section of the adhesive dispensing manifold taken along lines 8—8 of FIG. 5.
Figure 9:
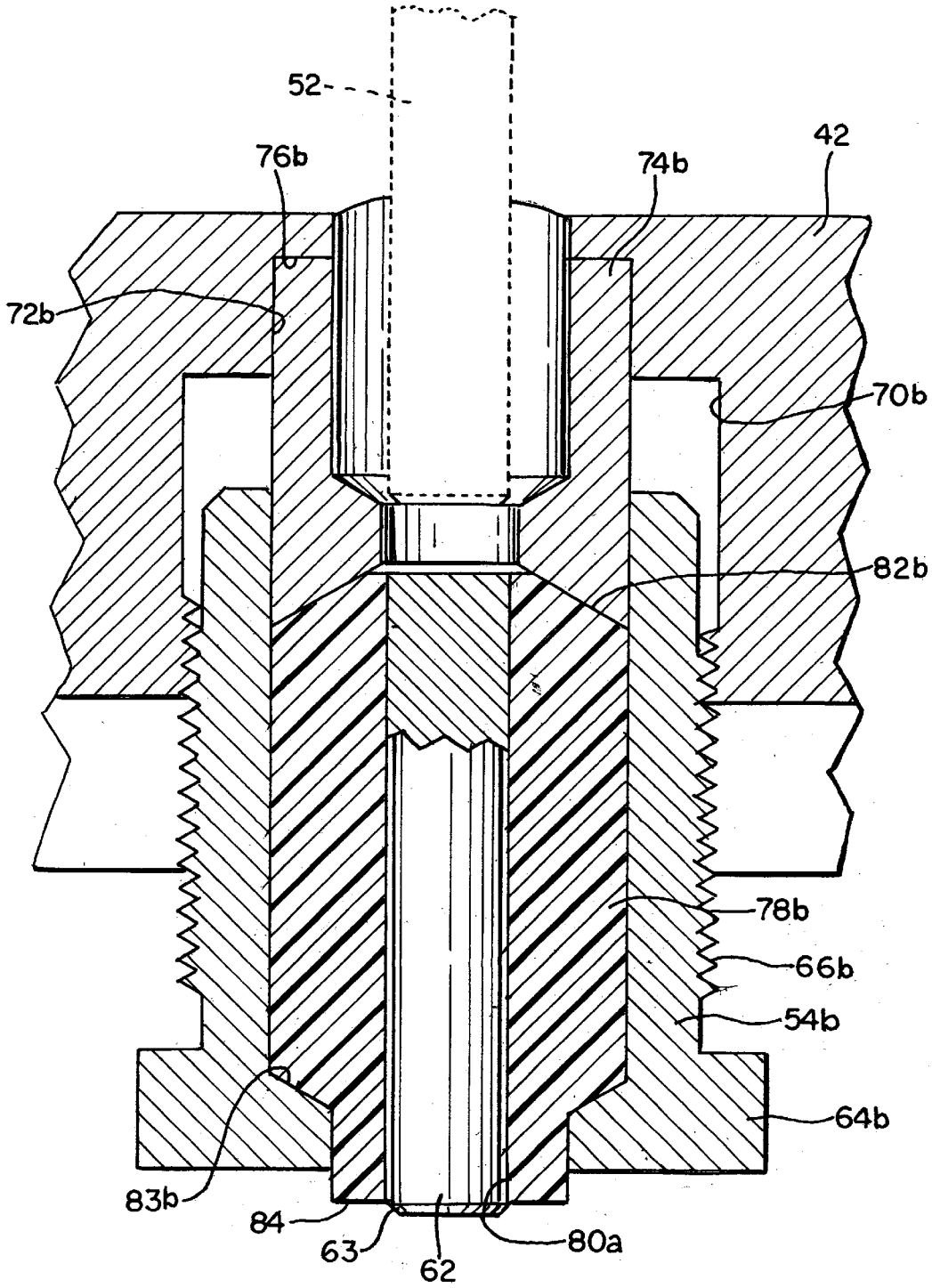
FIG. 9 is a close-up of the cross section from FIG. 8 at the dispensing nozzle end.

Now referring to FIGS. 8 and 9, an individual bead dispenser generally indicated as 59 is shown. It can be seen that valve stem 52 of dispenser 59 has an externally threaded upper end 60, and an opposite nozzle end 62 having a small radius 63 at the outside diameter thereof. Regarding retainer rings 54*a* and 54*b*, each retainer respectively has a hexagonal shaped head 64*a* or 64*b*, external threads 66*a* or 66*b*, and a variable diameter bore 68*a* or 68*b* therethrough. Also evident in FIGS. 8 and 9 are variable diameter manifold throughbores 70*a* extending upwardly from passage 58 and out the top of manifold 42 and a lower variable diameter manifold throughbore 70*b* extending through the bottom of manifold 42. One portion 72*a* of bore 70*a* is sized to accommodate a sleeve 74*a*, and a portion of bore 70*b* is sized to accommodate sleeve 74*b*. Also located in bore 70*a* is a bearing surface 76*a* and a bearing surface 76*b* is located in bore 70*b*. Adhesive dispenser head 18*a* also contains a fitting 78*a* at the upper end of manifold 42 and a fitting 78*b* at the lower end of manifold 42. Each fitting 78*a* and 78*b* respectively have a central bore 80*a* or 80*b*, a tapered end 82*a* or 82*b* at one end thereof and an angled shoulder 83*a* or 83*b* within bore 80*a*, 80*b*. In addition, fitting 78*b* has a nozzle tip 84 at the end opposite taper 82*b*.

Figure 10:
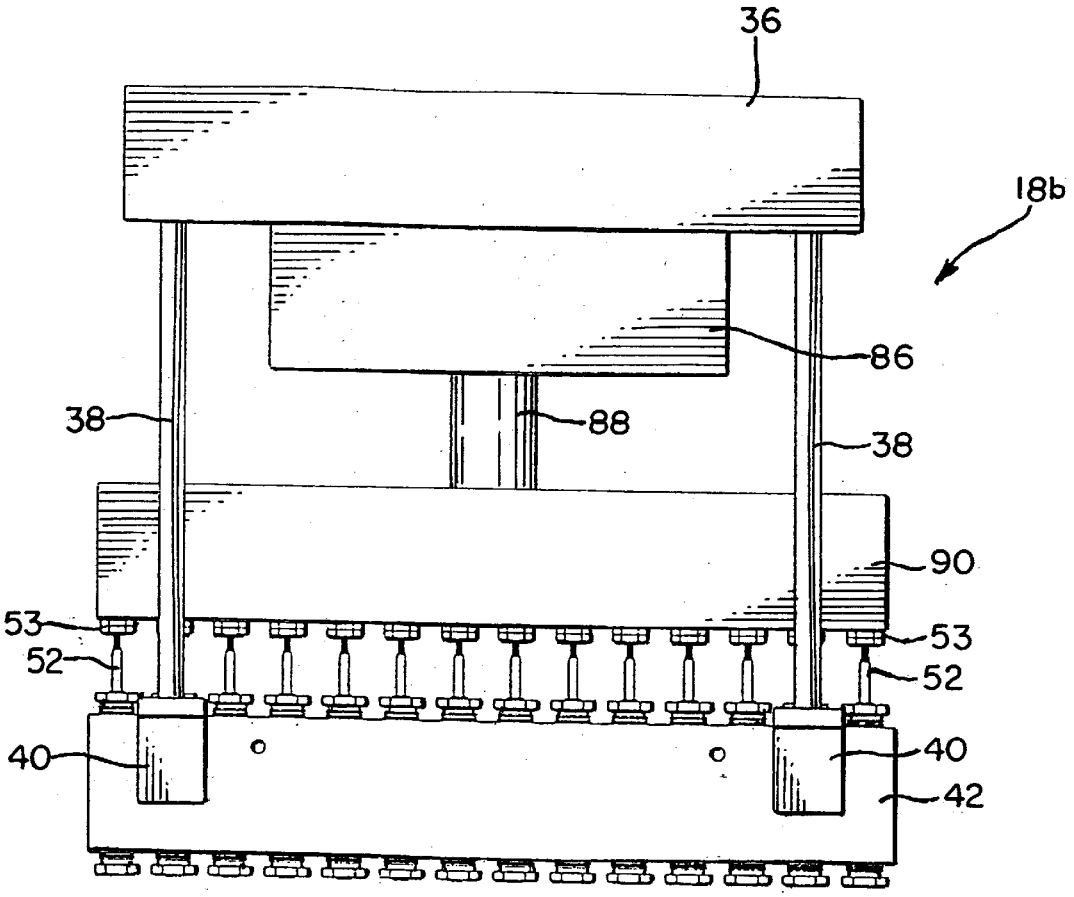
FIG. 10 is front view of a multi actuated adhesive dispenser head.

Now referring to FIG. 10, the multi or gang actuated adhesive dispenser head 18*b* is depicted. Like dispenser head 18*a*, dispenser head 18*b* includes channel support 36, vertical supports 38 and mounting brackets 40. Furthermore, manifold 42 and the associated parts thereof depicted in FIGS. 4–9 are identical for head 18*b* as compared to head 18*a*. However, gang actuated head 18*b* has only a single pneumatic cylinder 86 instead of the multiple cylinders 44*a* and 44*b* of head 18*a*. Also, head 18*b* has only one extension rod 88 which is connected to valve stems 52 by an activation block 90.

Now having discussed the component parts of adhesive dispensing unit 10, the assembly will be discussed in further detail. As seen in FIG. 1, support frame 12 is connected to side rail 17 of conveyor assembly 16 by upright frame members 22. This connection may be made by any method well known in the art such as with bolts or by welding. Control unit 14 is likewise affixed to side rail 17 in a convenient location near frame assembly 12. Support frame 12 is also used to support pneumatic lines 30 and adhesive lines 32.

In the embodiment depicted in FIG. 1, adhesive dispensing unit 10 includes one individually actuated adhesive dispenser head 18*a* adjacent three gang actuated adhesive heads 18*b*. Pneumatic lines 30 provide air pressure to all pneumatic cylinders 44*a*, 44*b*, and 86 via a distribution system (not shown) which is well known in the art. Adhesive lines 32 are connected to manifold blocks 42 at adhesive inlet apertures 56 found on each manifold.

Now referring to the details of the assembly of individually actuated adhesive dispenser head 18*a*, the upper row of pneumatic cylinders 44*a* are attached to channel support 36. The lower row of pneumatic cylinders 44*a* are attached and supported by divider plate 46. Each pneumatic cylinder 44*a*, and 44*b* receives pressurized air from pneumatic line 30. Furthermore, the pneumatic cylinders are electrically connected to control unit 14 and each cylinder has a solenoid valve (not shown) which can be individually controlled and switched on or off. The top end of each extension rod is directly connected to its correlative pneumatic cylinder. The bottom ends of the extension rods have a threaded bore (not shown) for receiving valve stems 52, which are tightly secured by jam nuts 53. Numerous openings are provided in divider plate 46 such that long extension rods 48*b* pass therethrough and between adjacent pairs of lower pneumatic cylinders 44*a* to be attached to the corresponding valve stem 52. There is sufficient room in the opening and between the cylinders such that extension rods 48*b* can freely reciprocate up and down as activated by the pneumatic cylinder. It should also be appreciated that the two-tier design of cylinders 44*a* and 44*b* allows for closer spacing of each dispensing nozzle and thereby closer spacing of applied adhesive beads on substrate 34 than would be possible if all pneumatic cylinders were placed at the same height. It should also be realized that vertical supports 38 and mounting brackets 40 secure manifold 42 to channel support 36 and is therefore fixed from movement relative thereto.

In the preferred embodiment, bore 70*a* and 70*b* are symmetrical about passage 58. Furthermore, retainer rings, 54*a*, sleeves 74*a*, and fittings 78*a* are identical respectively to retainer rings 54*b*, sleeve 74*b* and fitting 78*b* to facilitate part interchangeably and reduce the cost of parts.

Manifold 42 is preferably machined from stainless steel or another corrosive resistant material as are sleeves 74*a* and 74*b*. Sleeves 74*a* and 74*b* are press fitted into bore portions 72*a* and 72*b* respectively. Bearing surfaces 76*a* and 76*b* limit the depth to which sleeves 74*a*, 74*b* may pass into the bores. At the opposite end of sleeves 74*a*, 74*b*, tapered ends 82*a*, 82*b* of fittings 78*a*, 78*b* are pressed into the sleeves by threading retainer rings 54*a*, 54*b* into internal threads located in bores 78*a*, 78*b* by turning hex heads 54*a*, 54*b*. The retainer rings bear against angled shoulders 83*a*, 83*b* thereby compressing fittings 78*a*, 78*b* against the sleeves.

Fittings 78*a*, 78*b* are preferably made from a non-stick compressible polymer such as polytetraflouroethylene (PTFE) or a chemically modified PTFE, which can provide improved creep resistance. The retainer rings 54*a*, 54*b* are torqued to approximately 2 to 8 foot pounds depending upon the application, fitting composition and operating temperature. The torque applied to the retainer rings presses tapered ends 82*a*, 82*b* of fittings 78*a*, 78*b* into the mating angled recess on the end of sleeves 74*a*, 74*b* which is opposite bearing surface 76*a*, 76*b*. The pressure compresses fittings 70*a*, 70*b* such that the fittings fit snuggly about valve stem 52, but will not preclude vertical movement thereof. The design of bores 70*a*, 70*b* is such that at the preferred torque range, the ends of retainer rings 54*a*, 54*b* opposite hex heads 64*a*, 64*b* are free, and the torque results solely from the compression of fittings 78*a*, 78*b* against sleeves 74*a*, 74*b*.

Now having discussed component parts and assembly of adhesive dispensing unit 10, the operational aspects will be discussed. First, the appropriate combination of dispensing heads 18*a* and 18*b* are selected based upon the proposed application. In addition, it is also determined which nozzles should dispense adhesive. The associated solenoids for the nozzles, which will not be dispensing adhesive, are switched off. Air pressure is provided to the pneumatic cylinders in a range of 60 to 120 psi and regulated as required by regulator 31. The adhesive travels under pressure through feed lines 32 to dispensing heads 18*a*, 18*b* in a moisture free environment. When the bead dispensers 59 are in a closed or non-dispensing position, as shown in FIG. 8, nozzle end 62 of valve stem 52 is approximately flush with nozzle tip 84 of fittings 78*b*. However, it should be realized that valve stem 52 may be displaced somewhat within fitting 78*b* extended beyond from nozzle tip 84 such that the dispenser will still be in the closed or non-dispensing position. Although, it should be realized that if nozzle end 52 is located too far within bore 80*b* when in a closed position, exposed adhesive may harden at the end of the bore and obstruct adhesive flow.

When it is desired to start dispensing adhesive, the pneumatic cylinder 44*a*, 44*b*, and 86 are actuated with the solenoid valves to draw valve stem 52 upward such that nozzle end 62 is retracted past fitting 78*b* into sleeve 74*b* or passage 58 (as shown by the phantom lines of valve stem 52 in FIG. 9). It should be evident from the above assembly description, that each of pneumatic cylinders 44*a* and 44*b* will control one valve stem 52 in head 18*a*, while cylinder 86 will simultaneously move all valve stems 52 in the corresponding head 18*b* as facilitated by connection rod 88 and activation block 90. In this position, dispenser 59 will dispense adhesive out of nozzle tip 84. The flow path for adhesive is from lines 32 through apertures 56 into passageway 58 of manifold 42. As the adhesive is under pressure, it will be forced around valve stem 52 and through the bore of sleeve 74*b* and bore 80*b* of fitting 78*b* so that it exits from nozzle tip 84 onto substrate 34. Adhesive unit 10 may also be equipped with waterlines and misting valves (not shown) for misting dispensed adhesive with moisture to enhance the curing process.

When it is desired to terminate the flow of the adhesive, the solenoids are reversed causing pneumatic cylinders 44*a*, 44*b*, and 86 to drive the valve stem 52 back into bore 80*b* of fitting 78*b* such that nozzle end 62 is approximately flush with nozzle tip 84. Radius 63 is designed to facilitate a smooth reentry of valve stem 52 into bore 80*b*. As noted previously, based upon the torque in retaining ring 54*b*, fitting 78*b* is compressed such that there is a slight interference fit between valve stem 52 and bore 80*b*. As fitting is comprised of a non-stick polymer, valve stem 52 can slide within bore 80*b*. As dispenser 59 is closed, this interference fit causes valve stem 52 to push any adhesive within 78*b*, which may have been exposed to the environment, out of nozzle tip 84. Furthermore, the interference fit provides an environmental barrier and precludes any moisture from entering into the adhesive dispenser, thereby, preventing blockage or malfunction as a result of adhesive hardening within manifold 42. The design is such that the only place unintentional curing of adhesive may take place is upon the external portions of nozzle end 62, nozzle tip 84 or the bottom end of retainer ring 54*b*. To prevent a buildup of cured adhesive on these parts, the preferred embodiment includes a cleaning roller 92 (FIG. 3). The roller may be turned by any known means for providing rotation, such that any cured adhesive on these portions may be wiped and removed by engaging and rotatingly brushing said areas with the roller to remove the adhesive. Said rollers may be of a type similar to a paint roller, and to facilitate the cleaning process, the rollers may be coated with a cleaning oil such as a sulphinic ester of phenol. Mesamoll™, which is an alkysulfonic acid ester of phenol, as is available from Bayer Corporation, has been found to be particularly suitable for use on the cleaning rollers.

In the preferred embodiment, Hostaflon TFM 1700™ which is available from the Hoechst Corporation has been found to be a suitable material for use in making fittings 78*a* and 78*b*. Hostaflon TFM 1700™ is a chemically modified second generation polytetraflourethylene (PTFE) which has a lower deformation under load and increased creep resistance than non-chemically modified PTFE. Of course, any other suitable material providing the non-stick or compressibility properties of PTFE may be utilized for the fitting, or other chemically modified PTFE's may also be acceptable.

The mounting framework and adhesive dispensing units disclosed provide quick flexibility and interchangeability. A head may be quickly changed by closing a glue valve fitting shutting of glue flow to the manifold, disconnecting the air cylinder lines, disconnecting the glue supply lines and removing the knob or nuts that hold the head into the channel support. A new head may be replaced and quickly installed by reversing the above sequence. It should also be realized that this interchangeability makes it possible to use any desired number and sequence of heads 18*a* and 18*b*.

Figure 11:
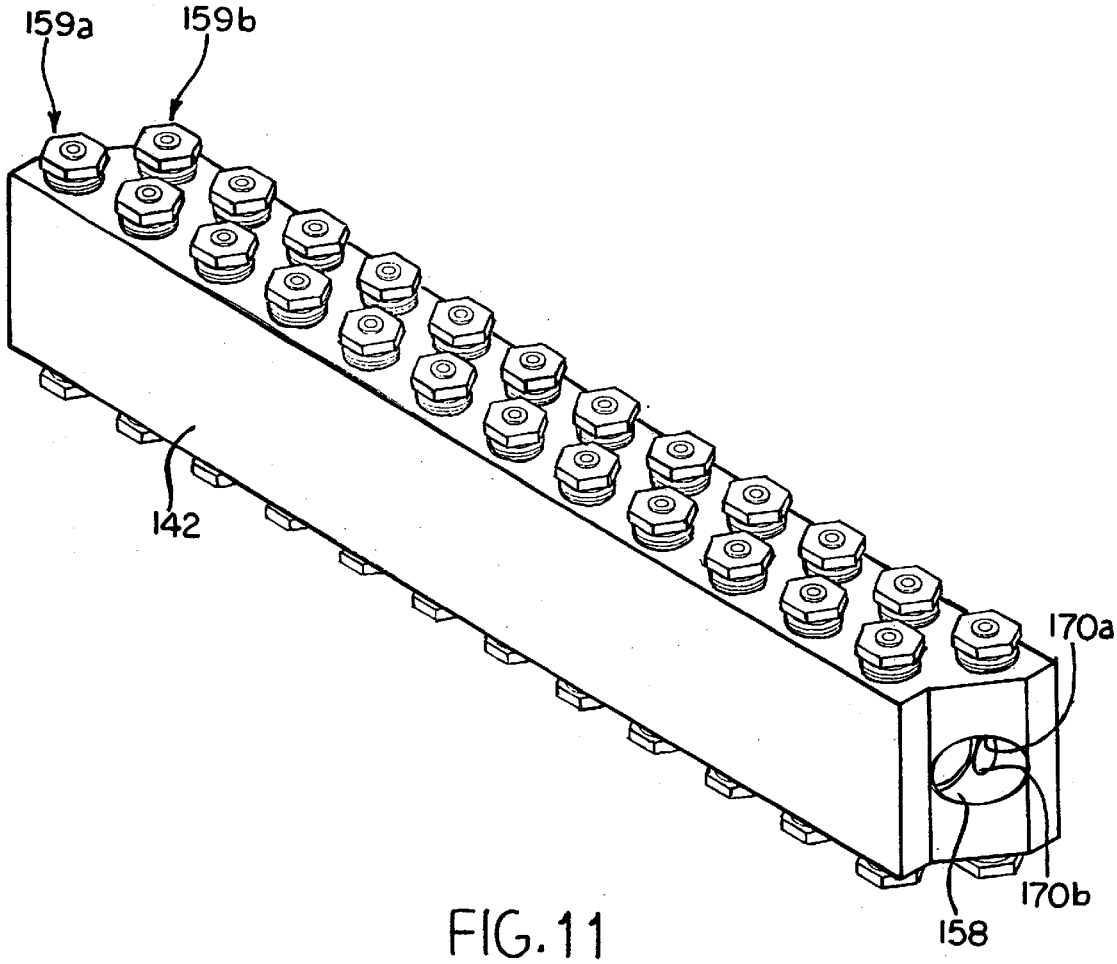
FIG. 11 is an alternate embodiment manifold.

An alternate embodiment manifold 142 is shown in FIG. 11. The main difference between manifold 142 and manifold 42 being that manifold 142 has two rows of adhesive bead dispensers 159*a* and 159*b* as opposed to the single row of adhesive bead dispensers in manifold 42. The arrangement of manifold 142 permits even closer spacing of adjacent dispensed adhesive beads. A through passage 158 through manifold 142 is similar to passage 58 except that passage 158 is elliptically shaped so that it connects with bores 170*a* and 170*b* on both bead dispensers 159*a* and 159*b*. All other aspects of manifold 142 are identical to manifold 42.

As has been outlined above, the preferred embodiments of adhesive dispensing unit 10 has been provided; however, it should be realized by one skilled in the art that numerous variations may be made without departing from the spirit and the scope of the invention. For example, other methods such as a rack and pinion system may be utilized to reciprocate valve stem 52 from the open and closed positions instead of the solenoids and pneumatic cylinders disclosed. A rack and pinion system would provide precise synchronization between activation and deactivation of the valve stems.

It should also be realized that the mounting framework of support frame 12 and the individual dispenser heads may be modified from the disclosed without departing from the spirit and scope of the invention. In addition, although a conveyor system has been shown for moving the part beneath the adhesive dispensing unit, it is possible to mount the adhesive dispensing heads on a traversing station such that the product could remain in place and the bead applicator would traverse over the product.

Furthermore, it is possible to make the height adjustment of adhesive dispensing heads 18*a* and 18*b* in numerous ways. As shown in FIG. 1, the heads are set to the appropriate height for depositing an adhesive bead on substrate 34 by adjusting dispenser supports 26 and vertical tracks 28. The vertical adjustment may be done manually and by holding the supports at the desired position using any common securing means such as a bolt. The height of the heads could also be adjusted with an automatic or semi-automatic rack and pinion system, chain or belt drive, or a balanced weight and pulley system.

Although the preferred embodiment uses identical parts in the upper and lower bores of the manifolds for interchangeability, it would be possible to vary the parts and dimensions between the upper and lower bores. It would also be possible to environmentally seal the area between pneumatic cylinders and manifold such that it would not be necessary to have the disclosed retainer ring, fitting, and sleeve around the valve stem at the top of the manifold block. It should also be appreciated that although the dispensing unit is particularly suitable for dispensing rapid moisture curable adhesives, that other types of adhesives may be used with this disclosed system.

From the foregoing, it should also be realized by someone skilled in the art that additional changes may be made in form and detail depicted without departing from the spirit and scope of the invention. Furthermore, the above embodiments are to be considered in all respects as only illustrative and not restrictive. Nor is the scope of the invention is limited by the above description, summary of the invention, or abstract, but rather by the following claims and equivalents thereof.

What is claimed is:

1. A manifold system for dispensing adhesive, comprising a housing having at least one inlet opening for receiving adhesive, least one outlet opening for dispensing adhesive, and a passageway between the inlet and outlet openings; a fitting of non-stick material in each outlet opening, said fitting having an opening therethrough for passage of adhesive; and an outlet closing member retractably located within each fitting, forming a seal between said closing member and said fitting and preventing adhesive flow from said outlet opening when said outlet closing member is in a closed position, said closing member being retractable from said fitting to an open position to permit adhesive flow through the outlet opening.

2. The manifold system for dispensing adhesive as set forth in claim 1, further comprising a retainer for retaining the fitting within the outlet opening.

3. The manifold system for dispensing adhesive as set forth in claim 2, further comprising a sleeve mounted in the outlet opening and bearing against a shoulder in the outlet opening.

4. The manifold system for dispensing adhesive as set forth in claim 3, wherein the sleeve has an opening, said sleeve opening is aligned with the fitting opening for passage of the outlet closing member and adhesive therethrough.

5. The manifold system for dispensing adhesive as set forth in claim 4, wherein the retainer adjustably presses the fitting against the sleeve.

6. The manifold system for dispensing adhesive as set forth in claim 5, wherein an end of the sleeve which is pressed against the fitting is tapered and a corresponding end of the fitting is tapered to provide a compression fit when said retainer ring is tightened.

7. The manifold system for dispensing adhesive as set forth in claim 2, wherein the fitting is made of a compressible material and the retainer is adjusted to compress the fitting to form the seal about the outlet closing member.

8. The manifold system for dispensing adhesive as set forth in claim 7, wherein the fitting includes a nozzle tip, and a nozzle end of said outlet closing member is substantially flush with said nozzle tip when in the closed position, and when in an open position said nozzle end is withdrawn into the housing beyond the fitting to allow adhesive material to flow through the fitting and out of the nozzle tip.

9. The manifold system for dispensing adhesive as set forth in claim 1, wherein the housing includes a third opening and a second fitting and a potion of said outlet closing member extends through said second fitting and said third opening and out of said housing to enable retraction of the outlet closing member.

10. The manifold system for dispensing adhesive as set forth in claim 9, including a pair of sleeves one of said sleeves being disposed in the outlet opening and one in the third opening.

11. The manifold system for dispensing adhesive as set forth in claim 10, further comprising a pair of retainers, one of said retainers for adjustably pressing the first fitting against the first sleeve and the second retainer for adjustably pressing said second fitting against said second sleeve.

12. The manifold system for dispensing adhesive as set forth in claim 11, wherein the fittings are made of a non-stick compressible material and the fittings and sleeves include mating tapers such that tightening said retainers will compress said fittings to form a slight interference fit with said outlet closing member.

13. The manifold system for dispensing adhesive as set forth in claim 9, wherein the portion of the outlet closing member extending out of said housing is threaded for receipt with an actuating mechanism.

14. The manifold system for dispensing adhesive as set forth in claim 1, having staggered rows of outlet openings.

15. A manifold system for dispensing adhesive, comprising a housing, having at least one inlet opening for receiving an adhesive, at least one outlet opening for dispensing adhesive, and a passage between the inlet and outlet openings; a sleeve seated within the outlet opening having a bore therethrough; a fitting also located within the outlet opening juxtaposed the sleeve, said fitting having a bore, said fitting bore being aligned with said sleeve bore; a retainer for retaining said fitting within said bore and adjustably pressing said fitting against said sleeve; and a valve closing member retractably located within said fitting in a closed position to prohibit adhesive flow, said closing member being retractable from said fitting to an open position to permit adhesive flow through the sleeve and fitting bores and out of said outlet opening.

16. The manifold system for dispensing adhesive as set forth in claim 15, wherein said fitting and said sleeve have mating tapered ends, and wherein said fitting and said sleeve are juxtaposed one another.

17. The manifold system for dispensing adhesive as set forth in claim 16, wherein the fitting is comprised of a compressible non-stick material; and wherein the retainer is adjusted to compress said fitting about said valve closing member to form a seal therebetween when said valve closing member is in said closed position.

18. The manifold system for dispensing adhesive as set forth in claim 15, further comprising at least one third opening in said housing, a second sleeve and a second fitting received in said housing, and a second retainer retaining said fitting, a potion of said valve closing member extending through said second sleeve, second fitting, and said second retainer, and out of said housing.

19. A modular adhesive bead dispensing unit comprising at least one bead dispensing module said module including a mounting frame for mounting the module to the unit; at least one adhesive dispensing manifold system, said manifold system including a housing having an inlet opening for introducing adhesive into the housing, an outlet opening for dispensing the adhesive, a non-stick compressible fitting within the outlet opening, said fitting having an opening therethrough and, an outlet closing member receivable within said fitting opening for starting and stopping flow of an adhesive bead from the head; and at least one actuation unit for retracting the outlet closing member from the fitting to an open position, and reinstalling the outlet closing member within the fitting opening to a closed position.

20. The modular adhesive bead dispensing unit as set forth in claim 19, further comprising a sleeve mounted in the outlet opening juxtaposed the fitting, and a retainer for retaining the fitting within the outlet opening and for adjustably pressing the fitting into the sleeve, said sleeve having an opening therethrough, said sleeve opening aligned with the fitting opening for passage of the outlet closing member and adhesive therethrough.

21. The modular adhesive bead dispensing unit as set forth in claim 20, wherein the retainer is adjusted to compress the fitting to form a seal between said fitting and outlet closing member when said outlet closing member is in a closed position.

22. The modular adhesive bead dispensing unit as set forth in claim 19, wherein the manifold system includes multiple outlet openings and a respective number of outlet closing members and separate actuation units connected to each outlet closing member.

23. The modular adhesive bead dispensing unit as set forth in claim 19, wherein the manifold system includes multiple outlet openings and a respective number of outlet closing members, and a single actuation unit connected to and actuating all outlet closing members simultaneously.

24. The modular adhesive bead dispensing unit as set forth in claim 19, wherein the fitting includes a nozzle tip and the outlet closing member includes a nozzle end, said modular bead adhesive dispensing unit further comprising a cleaning mechanism for wiping adhesive from said nozzle tip and said nozzle end.

25. A modular adhesive bead dispensing unit comprising at least one gang actuated adhesive dispensing module, and at least one individually actuated dispensing module, both said modules including a manifold system having a housing with at least one adhesive inlet, multiple outlet openings for dispensing adhesive, and a passageway connecting the inlet and outlet openings, and a retractable outlet closing member for each outlet opening, said gang actuated modules including a single actuation unit for moving all outlet closing members contained in said gang actuated module simultaneously from an open to a closed position, said individually actuated modules including a separate actuation device for each outlet opening and corresponding outlet closing member of said individual actuated module, said separate actuation devices independently moving each corresponding outlet closing member from the open to the closed position.

* * * * *

UNITED STATES PATENT AND TRADEMARK OFFICE

CERTIFICATE OF CORRECTION

PATENT NO. : 6,308,864 B1
DATED : October 30, 2001
INVENTOR(S) : Joseph S. Messer It is certified that error appears in the above-identified patent and that said Letters Patent is hereby corrected as shown below:

Claim 9,
Line 60, delete "potion" and insert -- portion --

Claim 18,
Line 47, delete "potion" and insert -- portion --

Signed and Sealed this

Nineteenth Day of March, 2002

*Attest:*

*Attesting Officer*

JAMES E. ROGAN
*Director of the United States Patent and Trademark Office*